US006644078B1

(12) United States Patent
Hung

(10) Patent No.: US 6,644,078 B1
(45) Date of Patent: Nov. 11, 2003

(54) LOCK FURNISHED WITH A REPLACEABLE LOCK CORE

(76) Inventor: Chung-I Hung, P.O. Box 96-405, Taipei 106 (TW)

( * ) Notice: Subject to any disclaimer, the term of this patent is extended or adjusted under 35 U.S.C. 154(b) by 0 days.

(21) Appl. No.: 10/354,741

(22) Filed: Jan. 27, 2003

(51) Int. Cl.[7] ..... E05B 27/00; E05B 29/00

(52) U.S. Cl. ..... 70/491; 70/371; 70/404; 70/351; 70/375

(58) Field of Search ..... 70/491, 371, 357, 70/373, 367, 369, 375, 404, 490, 378, 351, 360

(56) References Cited

U.S. PATENT DOCUMENTS

| | | | | | |
|---|---|---|---|---|---|
| 1,914,639 | A | * | 6/1933 | Hurd | 70/369 |
| 3,420,077 | A | * | 1/1969 | Drazin | 70/276 |
| 4,653,297 | A | * | 3/1987 | Moorhouse | 70/491 |
| 5,018,376 | A | * | 5/1991 | Lee | 70/491 |
| 5,020,349 | A | * | 6/1991 | Lee | 70/491 |
| 5,133,203 | A | * | 7/1992 | Huang | 70/360 |
| 5,400,629 | A | * | 3/1995 | Myers | 70/491 |
| 5,913,907 | A | * | 6/1999 | Lee | 70/58 |
| 5,921,118 | A | * | 7/1999 | Yuan | 70/201 |
| 6,058,750 | A | * | 5/2000 | Li | 70/358 |
| 6,357,271 | B1 | * | 3/2002 | Hsu | 70/491 |
| 6,550,299 | B1 | * | 4/2003 | Lin | 70/491 |

* cited by examiner

*Primary Examiner*—Anthony Knight
*Assistant Examiner*—John B. Walsh

(57) ABSTRACT

A lock furnished with a replaceable lock core, in which the inner lock assembly includes a lock core, a sleeve, and a control ring; the inner lock assembly is mounted in a fixed lock casing; the inner lock assembly and the lock casing are assembled together by means of a catch pin; the key normally used for unlocking the lock can only be turned clockwise without hindering the catching function between he inner lock assembly and the lock casing; when an inner lock assembly is replaced, the key should be inserted for unlocking, and then turned counter-clockwise so as to release the catching function between the lock casing and the inner lock assembly; then, pull the key outwards so as to pull out the inner lock assembly simultaneously, and the replacement of a new lock core for the lock casing is done simply.

7 Claims, 9 Drawing Sheets

LOCK FURNISHED WITH A REPLACEABLE LOCK CORE

BACKGROUND OF THE INVENTION

1. Field of the Invention

This invention relates to a lock device, and particularly to a lock furnished with a replaceable lock core.

2. Description of the Prior Art

In a conventional cylindrical lock, the inner space of the casing is mounted with an upper tumbler seat and a lower tumbler seat; a plurality of symmetrical tumbler holes are furnished between the upper and lower tumbler seats to be loaded with tumblers and springs respectively; normally, the springs in the tumbler holes will push the front ends of the front tumblers to the positioning edge of the front end of the casing. Since the tumblers are different in length, they can mate with different keys for unlocking; after a correct key is plugged into the cylindrical lock, the unlock grooves on the front end of the cylindrical lock will push the front tumblers to move forwards to an interface between the upper tumbler seat and the lower tumbler seat, i.e., the front tumblers and the rear tumblers are put along a rotary tangent surface; then, a turning and driving plate of the cylindrical key will drive the upper tumbler seat to turn, and a transmission shaft of the upper tumbler seat will drive a driving arm to turn.

In a conventional lock device, the lock lamina or the lock tumblers mounted in a body casing are different in structure, and the key for unlocking the same is also different in structure; therefore, the lock-up function is also different. In the conventional laminated lock structure, the assembling procedures thereof is rather simple aside from the picklock factors; it can obtain a high manufacturing precision without being unlocked with a master key.

In the conventional locks, different locks are substantially different in the structure of their tumblers, i.e., each type of lock has its features; after a given period of being sold, the locking function thereof is subject to being learned or known by other person, and then it is subject to being unlocked easily.

In fact, the locking-up purpose of a lock can be achieved only when the toughness of the structure and the precision of a lock reach a given standard as desired; then, the convenience in use and repair is another consideration to a lock.

SUMMARY OF THE INVENTION

The prime object of the present invention is to provide a lock furnished with a replaceable lock core, in which the lock casing of the cylinder-shaped lock device has a cylindrical hole for mounting an inner lock assembly; the cylindrical hole of a sleeve of the inner lock assembly is to be mounted with a control ring and a lock core; the control ring is furnished with two control cylindrical surfaces having different turning direction, i.e., a key inserted to unlock a lock device in one turning direction, or in another turning direction to pull out an inner lock assembly to replace a new lock core.

Another object of the present invention is to provide a lock furnished with a replaceable lock core, in which the lock casing of the lock device may not be removed upon pulling out the inner lock assembly for replacement so as to minimize the cumbersome steps to the related parts.

Still another object of the present invention is to provide a lock furnished with a replaceable lock core, in which the center cylindrical hole of the lock casing in the lock device is for mounting an inner lock assembly; the key of the lock has a key plate, which is furnished with a positioning block; the length of the positioning block is varied with the function of a key, i.e., a key for unlocking the lock, or a key for replacing an inner lock assembly; to replace an inner lock assembly, the key should be used to unlock the lock core before pulling out the inner lock assembly.

A further object of the present invention is to provide a lock furnished with a replaceable lock core, in which a control ring is mounted in the sleeve of the inner lock assembly; a control cylindrical surface of the control ring is furnished with a guide slot for receiving a key; both sides of the guide slot are furnished with two control cylindrical surfaces respectively with different length; normally, the key is turned clockwise, and the positioning block of the key will turn along the control cylindrical surface for unlocking without hindering the retaining relation between he inner lock assembly and the lock casing.

A still further object of the present invention is to provide a lock furnished with a replaceable lock core, in which the control ring of the inner lock assembly has a control cylindrical surface to be used for replacing an inner lock assembly; in that case, a key with a short positioning block; when the lock core is unlocked, the key is turned clockwise, and then the key is turned counter-clockwise so as to have the positioning block moved along the control cylindrical surface of the control ring; when the transmission shaft of the lower tumbler base is turned, the cut slot thereof will move to the lower end of the catch pin; then, the catch pin will release the catching relation between the inner lock assembly and the lock casing as a result of being pushed by a spring; the inner lock assembly will be pulled out upon the key being pulled, and the replacement of a new lock core in the inner lock assembly is done.

DETAILED DESCRIPTION OF THE PREFERRED EMBODIMENT

Figure 1:
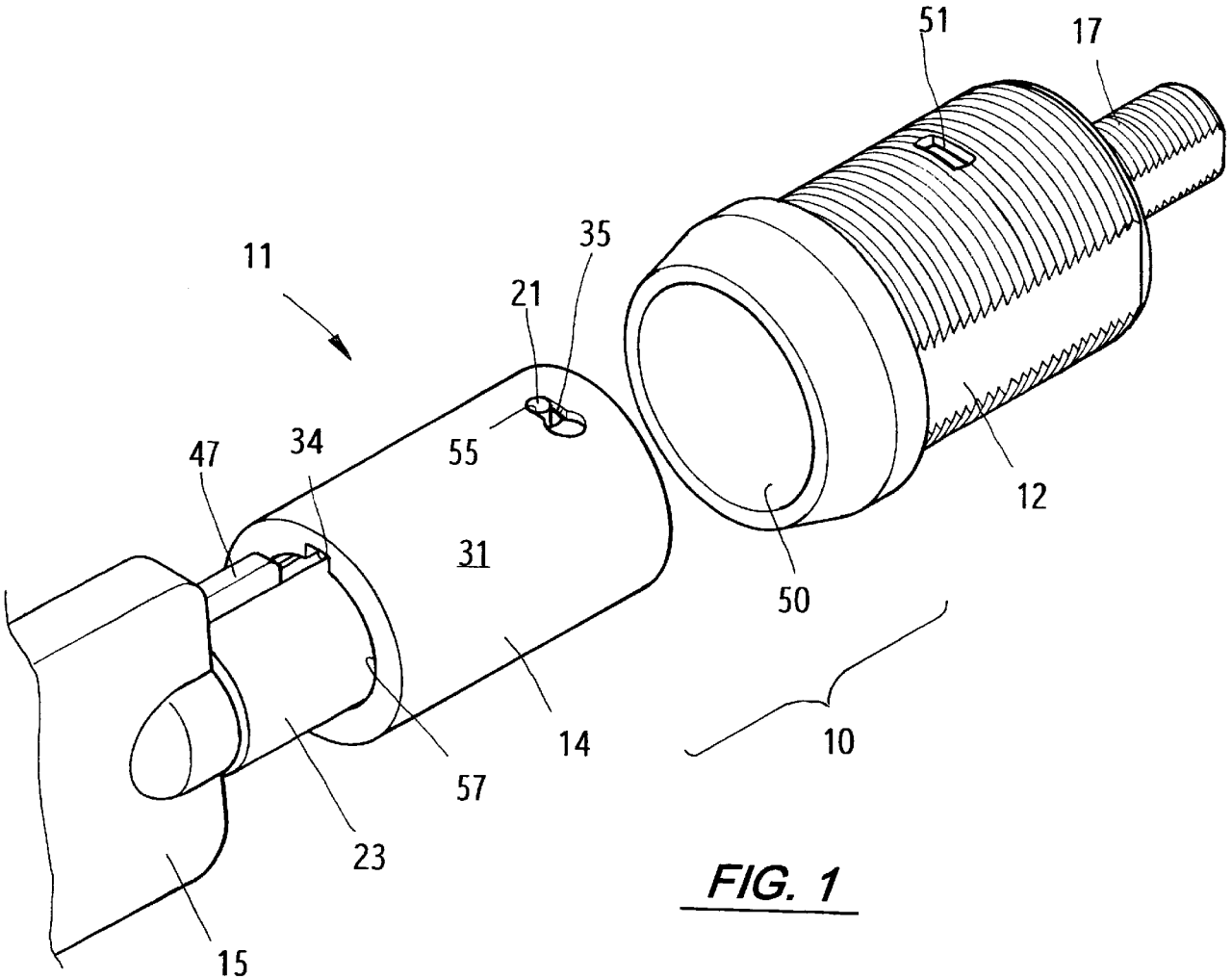
FIG. 1 is a disassembled view of the present invention, showing the inner lock assembly being removed with a key.
Figure 2:
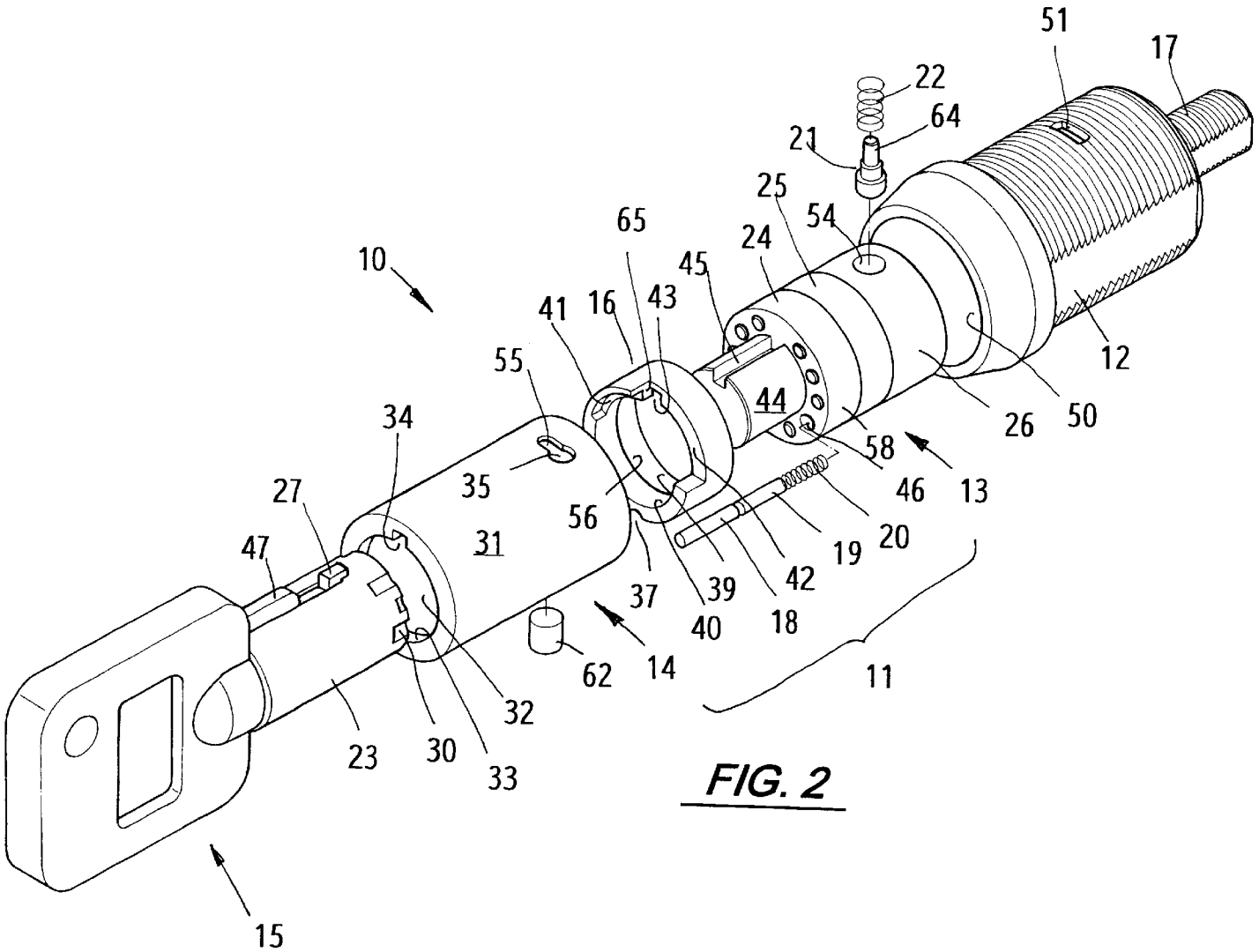
FIG. 2 is a disassembled view of the present invention, showing the parts of the lock.
Figure 3:
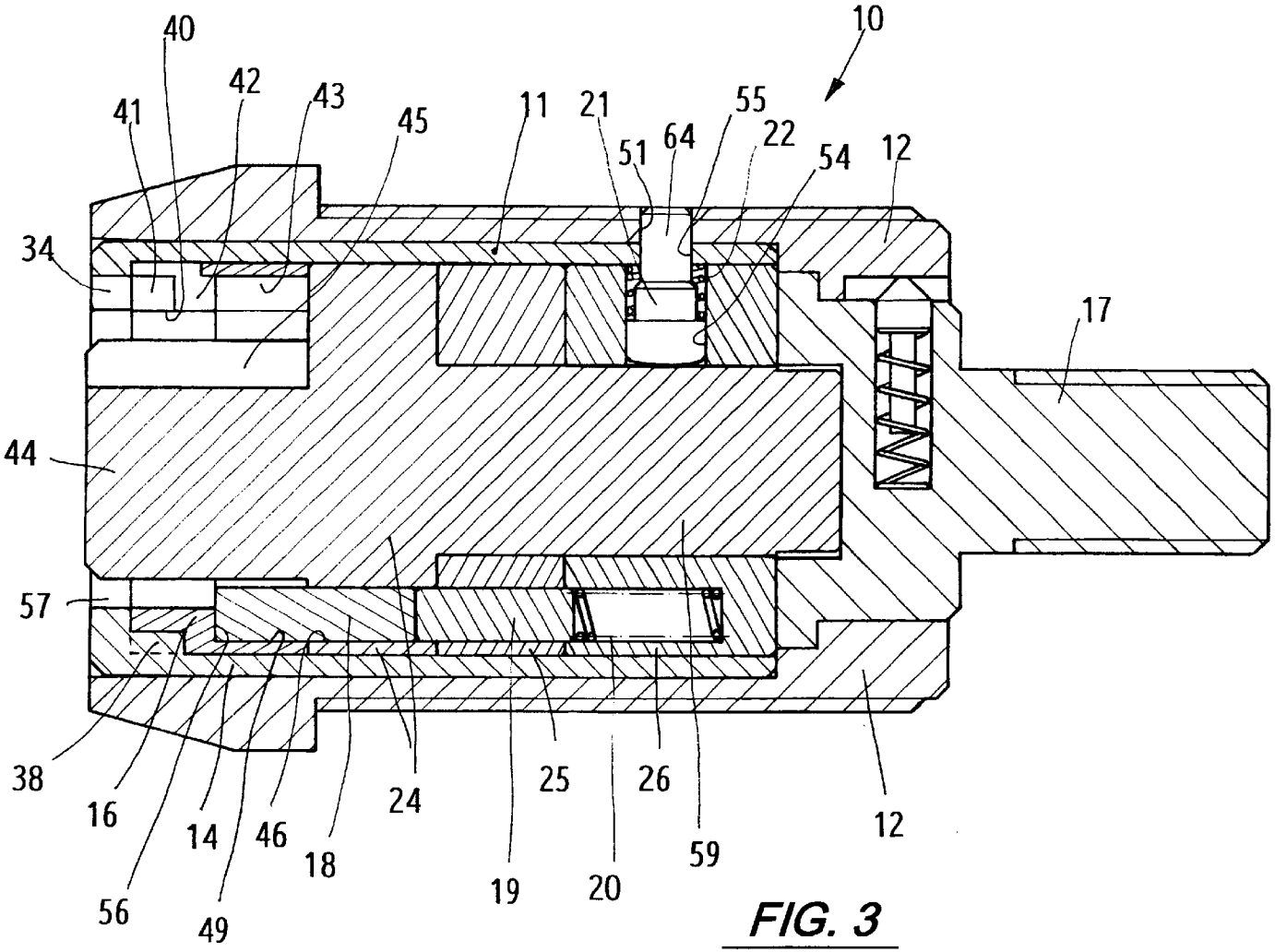
FIG. 3 is a sectional view of the present invention, showing the structure relation among the assemblies.
Figure 4:
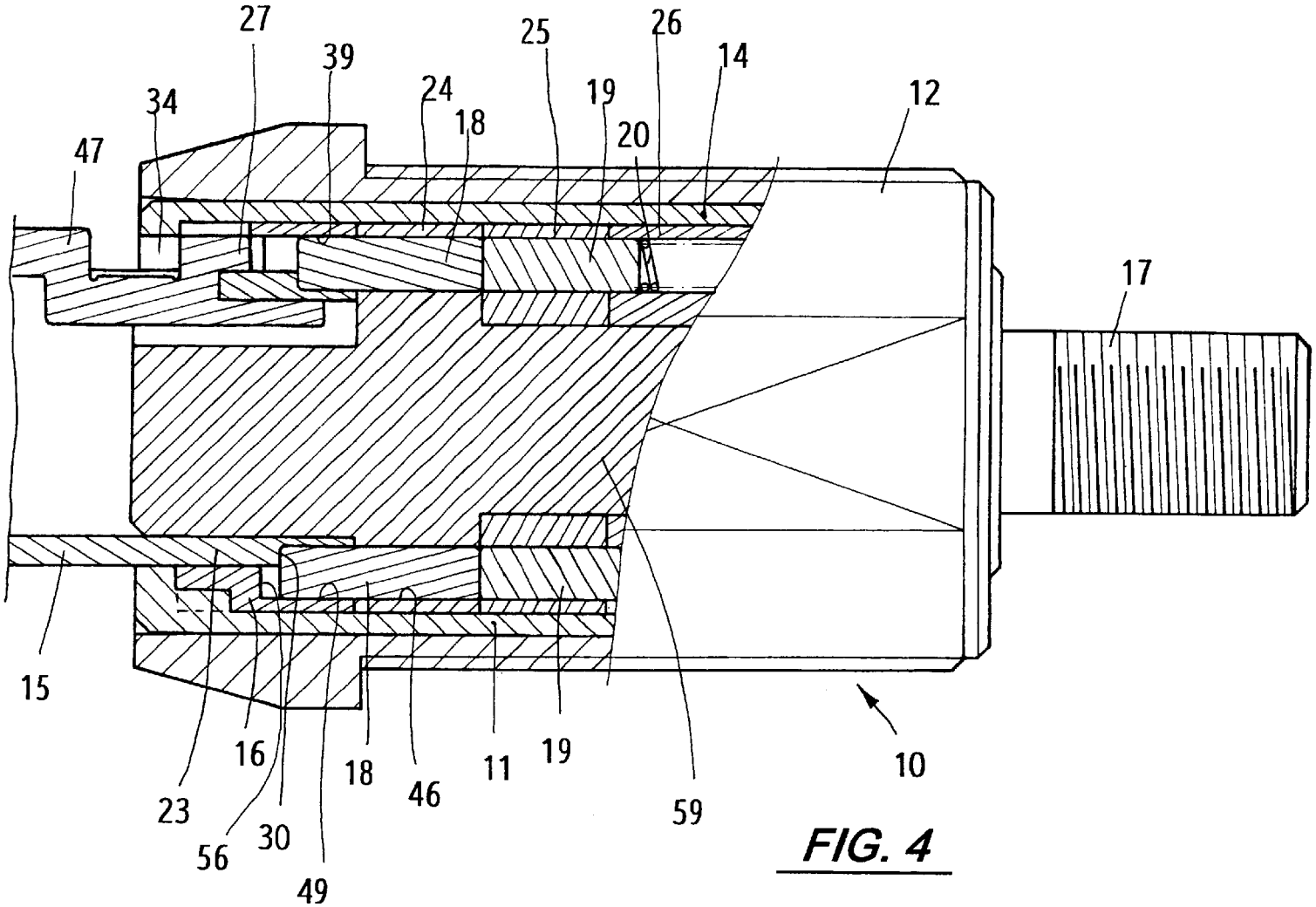
FIG. 4 is a sectional view of the present invention, showing a key being inserted into a lock normally.

This invention relates to a lock furnished with a replaceable lock core; as shown in FIGS. 1 to 3, the lock device 10 comprises a lock casing 12, an inner lock assembly 11 and a key 15; after the lock casing 12 is fastened in place, the inner lock assembly 11 can be replaced; after a key 15 is unlocking the inner lock assembly 11, the transmission shaft 17 on the rear end of the lock casing 12 will be turned. The inner lock assembly 11 includes a sleeve 14, a control ring 16 and a lock core 13. The inner lock assembly 11 is furnished with a catch pin 21, which is used to have the inner lock assembly 11 fastened in the cylindrical hole 50 of the lock casing 12 upon the assembly 11 being mounted therein. Normally, the key should be turned clockwise to unlock an inner lock assembly 11 without releasing the catch pin 21; to remove and replace an inner lock assembly 11, the key 15 should be turned counter-clockwise so as to release the catch condition between the inner lock assembly 11 and the lock casing 12, and then pull out the key 15 and the inner lock assembly 11 as well; then, a new lock core can be mounted into the lock casing 12 to provide a new lock.

The cylindrical hole 50 of the lock casing 12 is mounted with a transmission shaft 17 at one end thereof, and the cylindrical hole 50 is mounted with an inner lock assembly 11; the outer surface of the lock casing 12 is furnished with threads. After the lock casing 12 is mounted in place, it will be fastened in place with a nut; the outer surface of the lock casing 12 is furnished with a catch slot 51 for receiving a catch pin 21 of the inner lock assembly 11. As soon as the inner lock assembly 11 is mounted in the cylindrical hole 50 of the lock casing 12, put a short shaft 64 of the catch pin 21 into the catch slot 51 so as to limit the inner lock assembly 11 to move unintentionally; the catch pin 12 can only be released with the key 15 upon unlocking or upon turning counter-clockwise.

The inner lock assembly 11 includes a sleeve 14, a control ring 16 and a lock core 13. The outer surface 31 of the sleeve 14 is designed to mate close with the cylindrical hole 50 of the lock casing 12; the center of the sleeve 14 is furnished with a cylindrical hole 32 for receiving the lock core 13 and the sleeve 14. The outer end of the cylindrical hole 32 is furnished with a short cylindrical surface 33 having a smaller diameter; after the lock core 13 is mounted into the hollow space of the short cylindrical surface 33, the stem body 44 of the mid-tumbler base 25 will be mounted therein so as to form into a key groove 57 of a cylinder-shaped key 23. The sleeve 14 has a central cylindrical hole 32, which and the short cylindrical surface 33 are formed into a shoulder for mounting a control ring 16 thereon. The outer surface of the control ring 16 has a positioning slot 37 to be engaged with a salient bead 38 on the shoulder of the sleeve 14 to prevent the control ring 16 from turning unintentionally. The center of the control ring 16 has a cylindrical hole 40 which forms into a hole extended and aligned with the short cylindrical surface 33 of the sleeve 14; the cylindrical hole 40 has an inner cylindrical hole 39 with a larger diameter, which is slightly larger than that of the outer curved surface of the tumbler hole 46 on the upper tumbler base 24 so as to mount around the tumbler hole 46 and to limit the moving distance of every front tumbler 18 of the lock core 13, i.e., all the tumblers 18 push against to the same curved surface.

Referring to FIGS. 2 to 8, the lock core 13 includes an upper tumbler base 24, a lower tumbler base 26, a plurality of front tumblers 18, a plurality of rear tumblers 19 and a plurality of springs 20; in a FIG., a mid-tumbler base 25 is furnished in order to provide more variety of the tumblers. The upper tumbler base 24 includes a stem body 44, a ring-shaped disk 58 and a transmission shaft 59; the outer end of the upper tumbler base 24 is furnished with a stem body 44 with a positioning slot 45; the diameter of the stem body 44 is designed to fit to the inner diameter of the cylinder-shaped stem 23 of the key 15 so as to guide the center surface of the cylinder-shaped stem 23; the positioning slot 45 is designed to fit to the corresponding position of the guide slot 34 of the sleeve 14 and the guide slot 43 of the control ring 16 so as to provide a guide function for the inner and outer positioning blocks of the key plate 47 of the cylinder-shaped stem 23 upon the key 15 being plugged in; the upper tumbler base 24 has a ring-shaped disk 58, of which one end has a transmission shaft 59; the mid-tumbler base 25 and the lower tumbler base 26 are to be mounted on the transmission shaft 59. The ring-shaped disk 58 of the upper tumbler base 24 is furnished with a plurality of tumbler holes 46 arranged on the end surface of the ring-shaped disk 58; the tumbler holes 46 extend through the surfaces of the mid-tumbler base 25 and the lower tumbler base 26 to form into a plurality of tumbler holes aligned and in communication with each other respectively; every tumbler hole is loaded with a spring 20, a rear tumbler 19 and a front tumbler 18; then, the lock core 13 is mounted in the cylindrical hole 32 of the sleeve 14; however, before the lock core 13 is mounted in the cylindrical hole 32, all the front tumblers 18 projected out of the tumbler holes 6 have different heights respectively, which are used for making the code of each key. After the lock core is mounted in the cylindrical hole 32, the outer end of the lower tumbler base 26 and the end of the sleeve 14 are placed on the same level; simultaneously, all the tumblers projected out of the tumbler holes 46 of the upper tumbler base 24 are set against the retaining ring 56 of the control ring 16, i.e., on the same level; in other words, all the front tumblers 18 with different length are set on a rotary tangent plane between the upper tumbler base 24 and the mid-tumbler base 25.

The outer surface 31 of the sleeve 14 is furnished with a limit slot 35, which is opposite to the lower tumbler base 26, and is similar to a conventional key hole. The limit slot 35 has two tangent holes with different diameters; the lower tumbler base 26 is furnished with a cylindrical hole 54 opposite to the limit slot 35; the catch pin 21 has a large diameter portion to be set in the large hole of the limit slot 35; after the catch pin 21 is mounted in the cylindrical hole 54, a spring 22 is mounted on the smaller diameter of a short shaft 64 of the catch pin 21;

finally, the small diameter shaft 64 at one end of the catch pin 21 is mounted in a small diameter hole 55, and then the catch pin 21 is set and confined in the cylindrical hole 54 of the lower tumbler base 26 and the round hole 55 of the sleeve 14. The larger diameter portion of the catch pin 21 is pushed with a spring 22 so as to have its end contacted with the surface of the transmission shaft 59 in the center of the lower tumbler base 26. The inner lock assembly 11 is assembled and retained with the catch slot 51 of the lock casing 12 by means of the catch pin 21 thereof.

After the inner lock assembly 11 is mounted in the cylindrical hole 50 of the lock casing 12, the inner lock assembly 11 will be assembled together with the lock casing 12 by means of the catch pin 21 and the catch slot 51. Normally, the inner lock assembly 11 can be unlocked by inserting the cylinder-shaped stem 23 of the key 15 into the lock to have positioning block 27 of the cylinder-shaped stem 23 of the key 15 inserted into the guide slot 34; the key slots 30 on the front end of the cylindrical-shaped stem 23 can push against all the front tumblers 18 to move so as to have all the front tumblers 18 and the rear tumblers 19 set on a tangent plane between the upper tumbler base 24 and the mid-tumbler base 25; then, turn the key 15 clockwise so as to drive the transmission shaft 59 under the lower tumbler base 26 to turn, and the transmission shaft 17 on the rear end of the lock casing 12 will be turned to unlock the lock device.

The positioning block on the cylinder-shaped stem 23 is designed into two kinds of the length; as shown in FIGS. 2, 4 to 8, the key for unlocking the lock device 10 has a longer positioning block 27; when such a key is inserted into the guide slot 34 of the sleeve 14, the positioning block 27 can extend into the control cylindrical surface 42 of the control ring 16. As shown in FIGS. 2, 9 to 13, the key for replacing a lock core 13 has a shorter positioning block 28; when such a key is inserted into the guide slot 34 of the sleeve 14, the positioning block 28 will extend into the control cylindrical surface 42 to be turned clockwise, and into the control cylindrical surface 41 to be turned counter-clockwise. Normally, the lock device 10 is unlocked with a key 15 having a longer positioning block 27. When the key 15 is inserted into the guide slot 34 of the sleeve 14 and into the guide slot 43 of the control ring 16, every key slot 30 of the cylinder-shaped stem 23 will push every front tumbler 18 to the unlocking position. The positioning block 27 will follow the key 15 to turn clockwise, i.e., to move within a scope as designed in the control cylindrical surface 42; when it is turned counter-clockwise, it can only return to the guide slot 43 of the control ring 16 as a result of being limited by the stop plane 65.

Every inner lock assembly 11 is encoded with a code by varying the length of the front tumblers 18 in the lock core 13. The inner lock assembly 11 and the lock casing 12 are retained together by means of the catch pin 21. Each inner lock assembly 11 includes two keys basically, i.e., one key used for normally unlocking the lock, and one key used for replacing the block core; in a normal key, the positioning block 27 has a longer length. To unlock a lock device, the positioning block 27 will extend into the guide slot 43 of the control ring 16, and then turn clockwise along the control cylindrical surface 42 of the control ring 16; when it is turned counter-clockwise, it will be stopped with the stop plane 65 of the guide slot 43 without moving further. To replace a lock core, the key plate 47 of the key with a shorter positioning block 28 is to be used in the same way as the normal key, i.e., the key slots 30 of the cylinder-shaped stem 23 will push the front tumblers 18 to the unlocked position; when the shorter positioning block 28 is turned clockwise, it will move along the control cylindrical surface 42 of the control ring 16; in that case, the surface of the transmission shaft 59 under the lower tumbler base 26 is in contact with the inner end of the catch pin 21 i.e., the catch pin 21 is unable to move inwards; the inner lock assembly 11 is engaged with the short shaft 64 of the catch pin 21.

Figure 5:
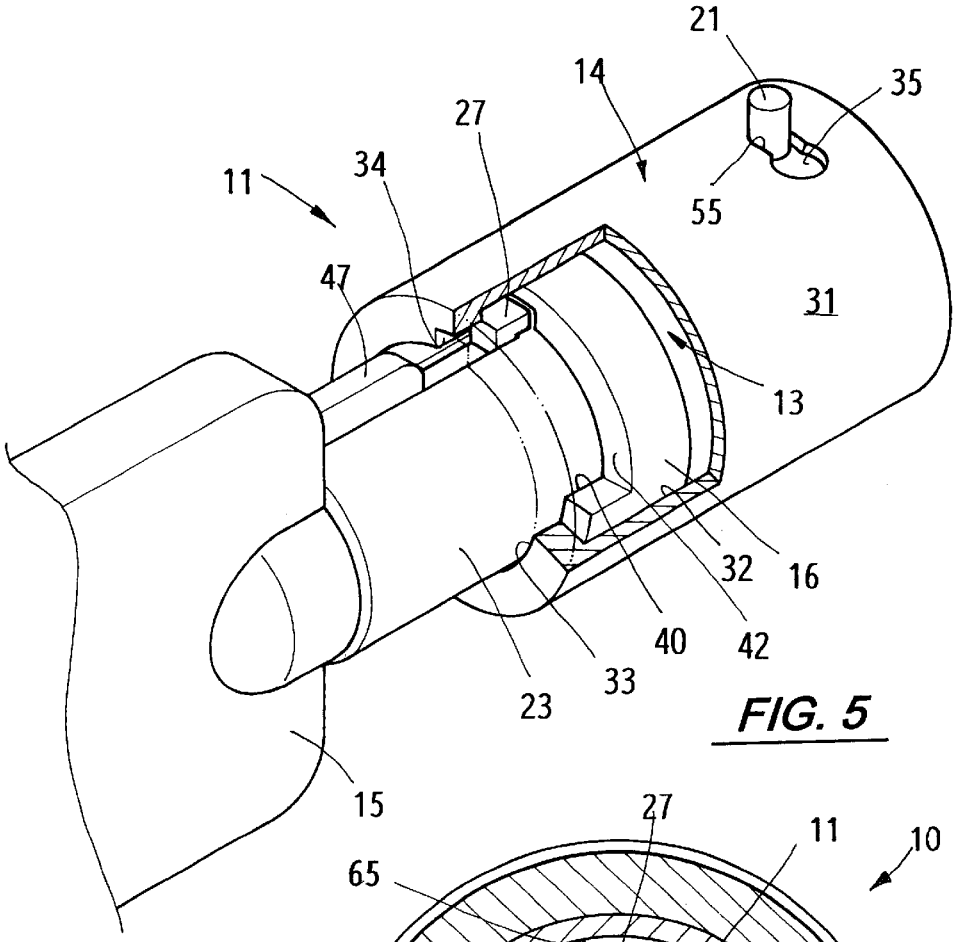
FIG. 5 is a perspective view of the present invention, showing a fragmental structure of the inner lock assembly.
Figure 6:
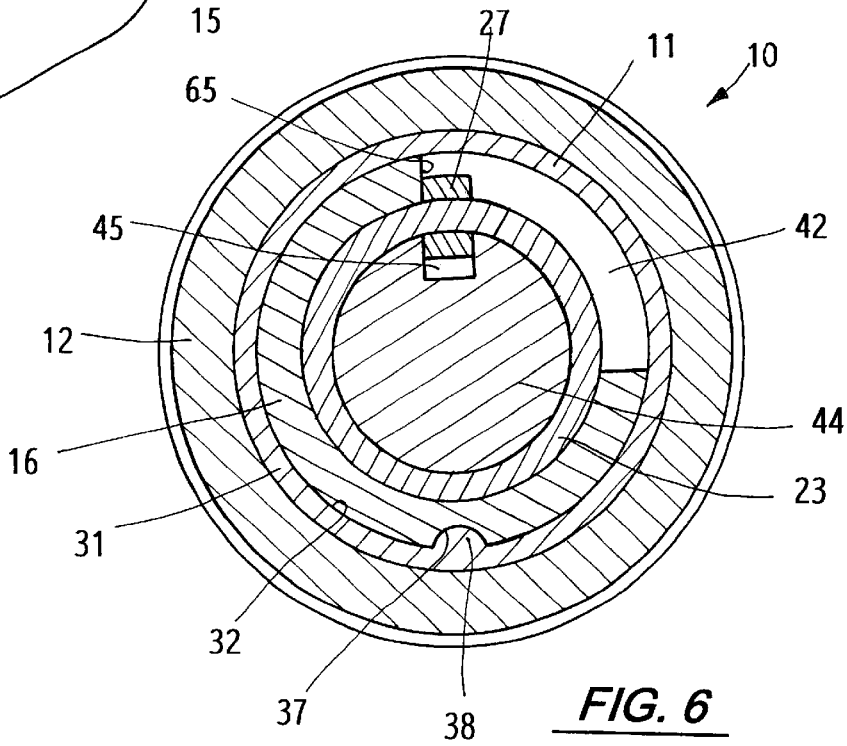
FIG. 6 is a sectional view of the present invention, showing the relation between the positioning block of a key and the control cylindrical surface thereof.
Figure 7:
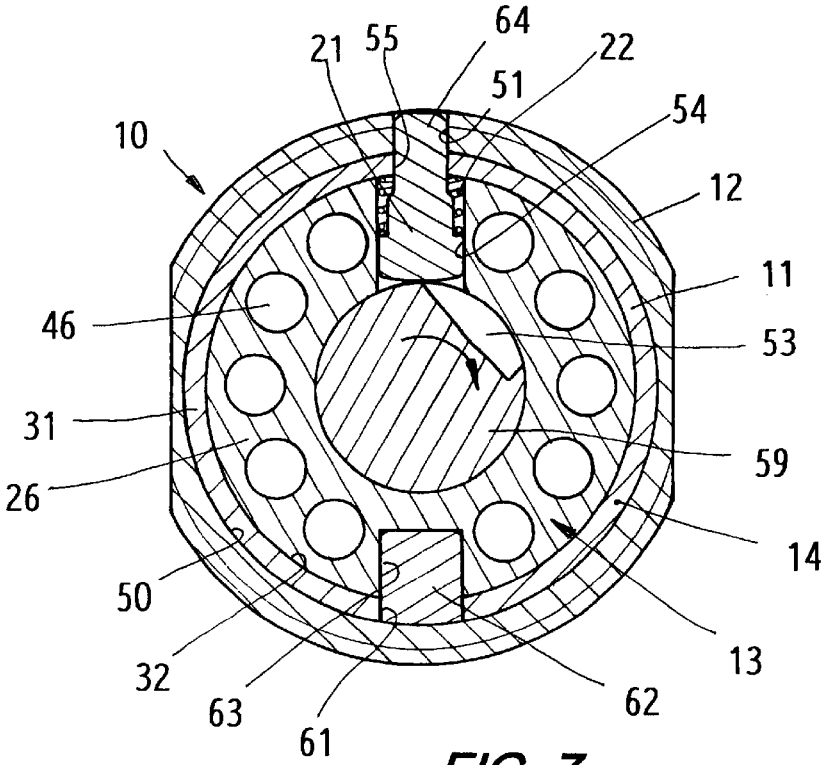
FIG. 7 is a sectional view of the present invention, showing the catch pin in a catch position.
Figure 8:
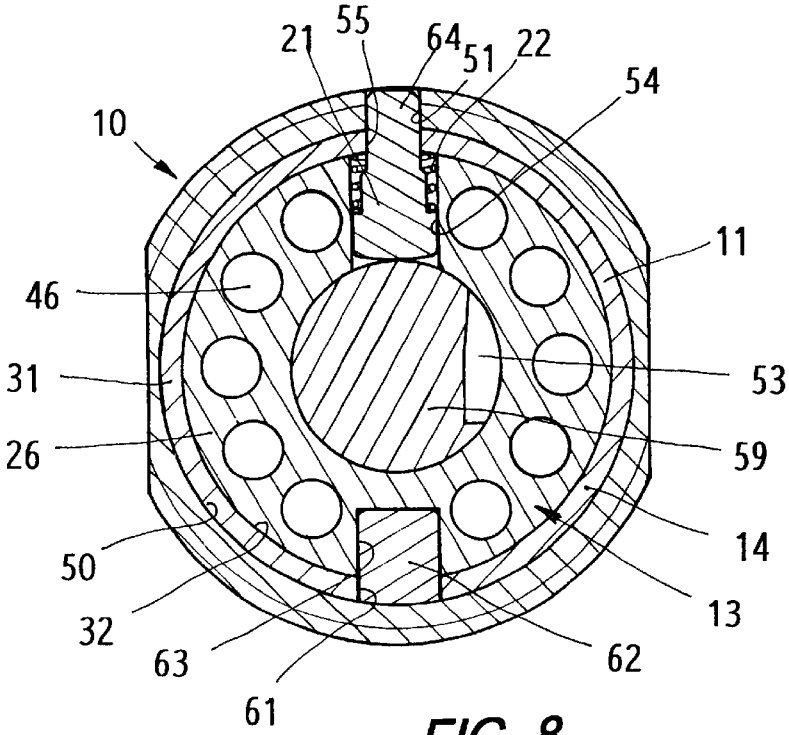
FIG. 8 is a sectional view of the present invention, showing the transmission shaft as shown in FIG. 7 being turned.
Figure 9:
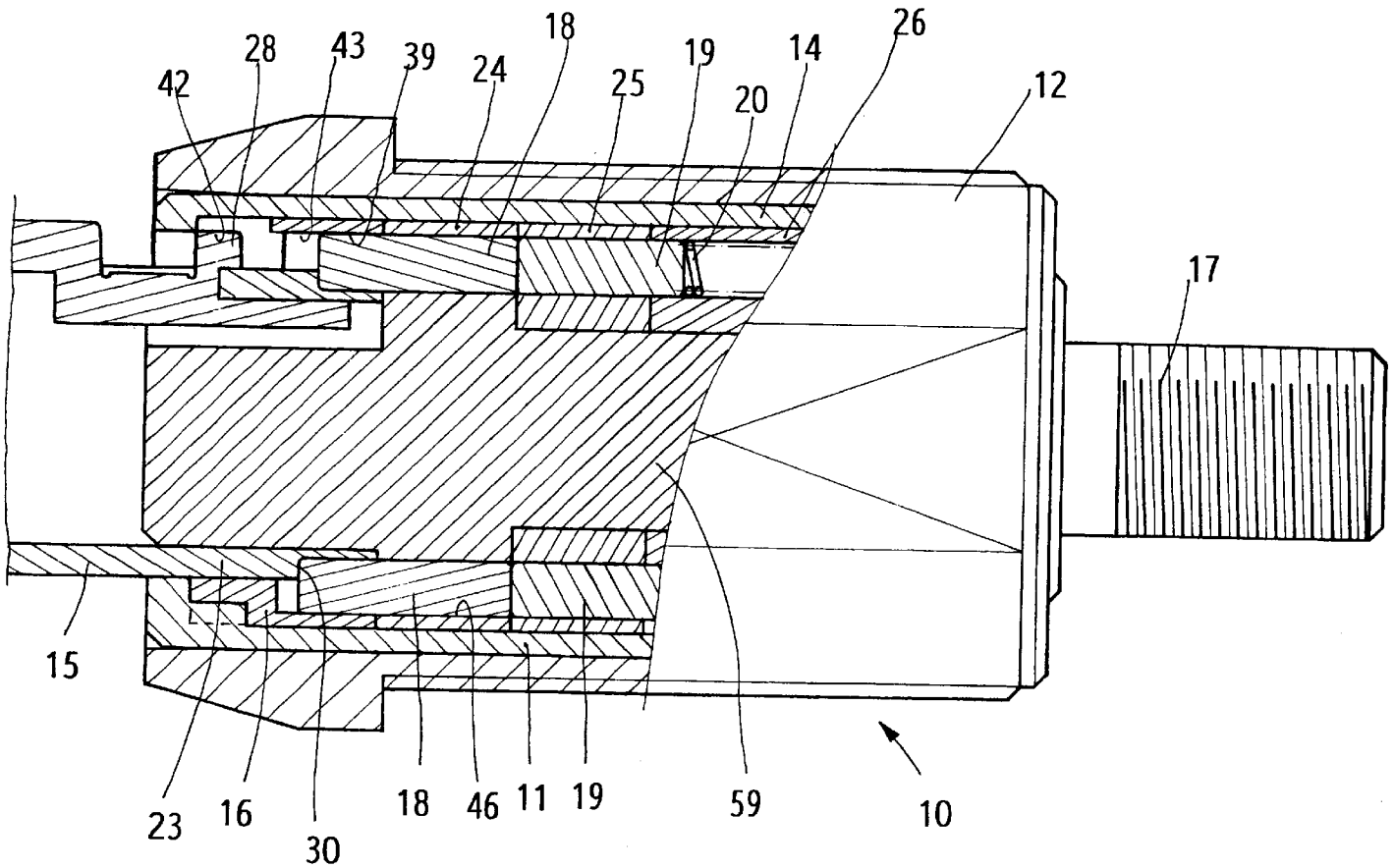
FIG. 9 is a sectional view of the present invention, showing a key inserted therein to remove an inner lock assembly.
Figure 10:
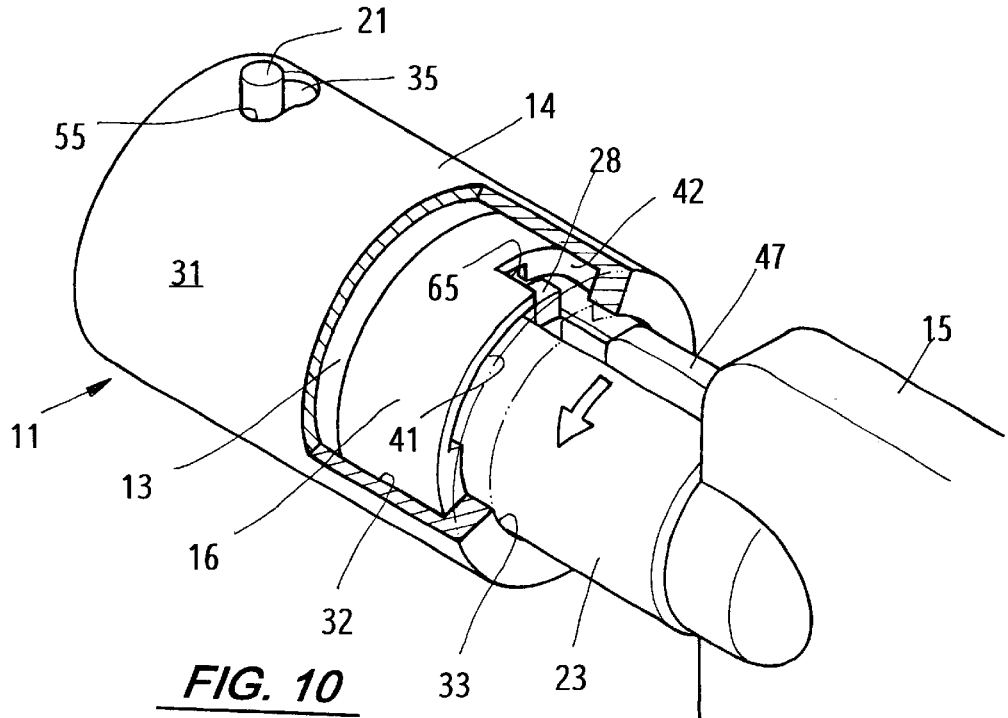
FIG. 10 is a perspective view of the present invention, showing a fragmental structure of the inner lock assembly.
Figure 11:
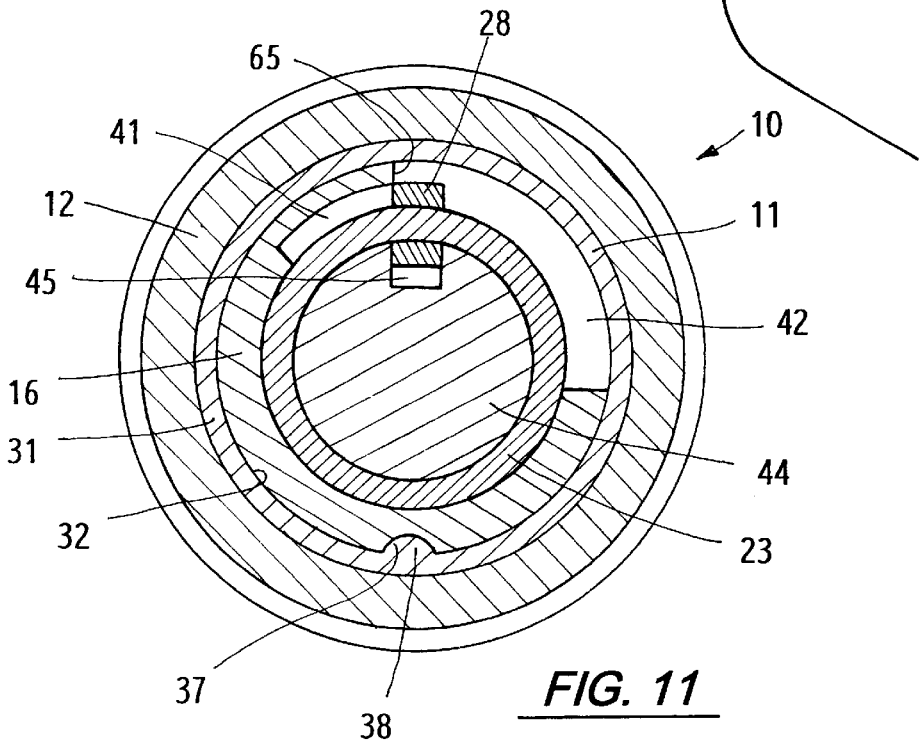
FIG. 11 is a sectional view of the present invention, showing the relation between the positioning block of the key and the control cylindrical surface hereof.
Figure 12:
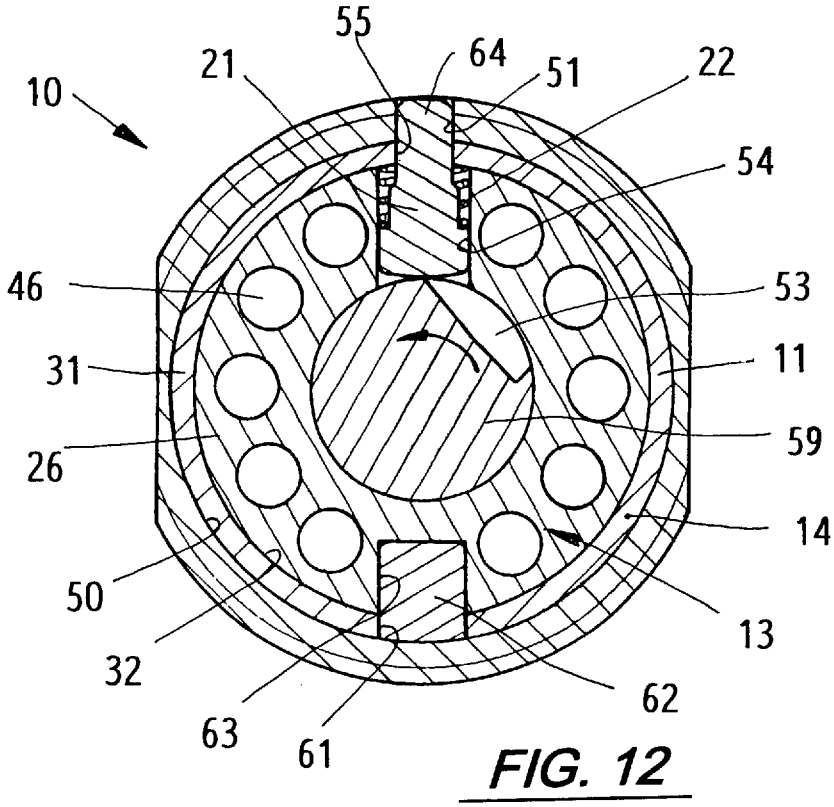
FIG. 12 is a sectional view of the present invention, showing the catch pin in a catch position.
Figure 13:
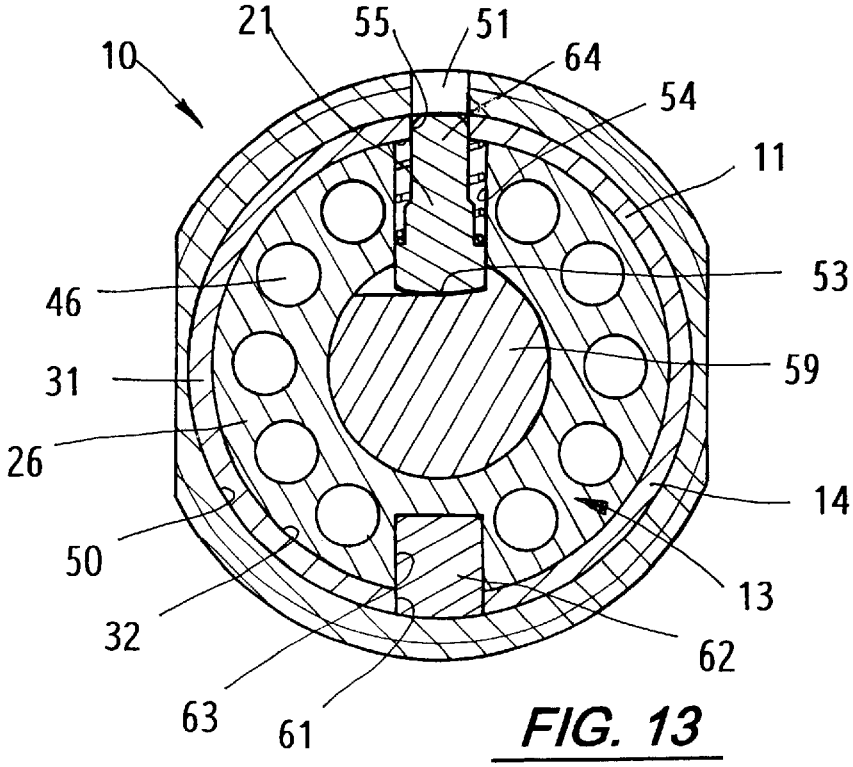
FIG. 13 is a sectional view of the present invention, showing the transmission shaft being turned as shown in FIG. 12.

As shown in FIGS. 5 and 8, the control ring 16 in the cylindrical hole 32 of the Sleeve 14 has a guide slot 43, beside which there is a deeper control cylindrical surface 42, which enable the key to plug in for unlocking the lock; then, the positioning block 27 of the key can turn along the control cylindrical surface 42 clockwise; one side of the guide slot 43 has a shallow control cylindrical surface 41 for receiving a key which is used for replacing a lock core as shown in FIGS. 10 and 11; when such a key is plugged in, the short positioning block 28 can turn along the control cylindrical surface 2 clockwise, and the key can unlock the lock. When the key is tuned counter-clockwise, the short positioning block 28 will turn along the control cylindrical surface 41 of the control ring 16 without being hindered.

When use a key 15 which is designed to replace an inner lock assembly 11, the key slots 30 of the cylinder-shaped stem 23 are used for pushing the front tumblers 18 to the unlocking position; when the key 15 is turned counter-clockwise, it will drive the upper tumbler base 24 to move; since the transmission shaft 59 of the lower tumbler base 26 and the upper tumbler base 24 are one assembly; the transmission shaft 59 and the upper tumbler base 24 can turn counter-clockwise simultaneously; then, the cut slot 53 on the transmission shaft 59 would have the catch pin 21 to moved counter-clockwise and slowly until the positioning block 28 of the key 15 being stopped. The catch pin 21 mounted in the cylindrical hole 54 of the lower tumbler base 26 is turned together with the transmission shaft 59 as a result of being pushed with a spring 22, and the catch pin will move into the cut slot 53 slowly until the short shaft 64 of the catch pin 21 and the surface of the lower tumbler base 26 being set on the same level; in that case, the outer surface 31 of the inner lock assembly 11 will disengage from the cylindrical hole 50 of the lock casing 12; then, pull the key 15 outwards so as to have the inner lock assembly 11 separated from the lock casing.

After the inner lock assembly 11 is pulled out of the lock casing 12 fixed on a plane, the previous inner lock assembly 11 may be mounted back, or a new lock core 13 fitted to the inner lock assembly 11 may be mounted therein. Before mounting a new lock corel 3 in place, a key 15 should be plugged into the guide slot of a new inner lock assembly, and turn it counter-clockwise so as to drive the transmission shaft 59 of the lower tumbler base 26 to turn, and to have catch pin 21 retracted into the surface of the limit slot 35; then, the catch pin would not hinder the new inner lock assembly to mount into the cylindrical hole 50 of the lock casing 12. After the new inner lock assembly is mounted in place, turn the key 15 clockwise until to the guide slot 34, and then pull out the key 15 to complete the replacement without damaging the lock casing 12.

The length of the positioning block of the cylinder-shaped stem 23 determines a key for normal unlocking a lock, or for replacing an inner lock assembly 11, and it is easy to identify a key. Simply, the front end of the lock core 13 is furnished with a control ring 16 to facilitate controlling the turning direction; a conventional catch pin 21 is furnished to have the inner lock assembly 11 and the lock casing 12 engaged together. When the inner lock assembly 11 is replaced for the lock device 10, the related parts connected with the transmission shaft 17 on rear end of the lock casing 12 would not be damaged, i.e., the replacement can be done simply by plugging the key 15, unlocking, turning counter-clockwise, and pulling the inner lock assembly 11 out; mount a new inner lock assembly 11 therein; then, plug the key 15 in and turn it counter-clockwise, and plug the inner lock assembly into the cylindrical hole 50 of the lock casing 12, and then turn it clockwise and pull out the key 15; the replacement of an inner lock assembly 11 is completed.

According to the description of the aforesaid embodiments, the features and structure of the present invention have been disclosed completely; it is apparent that the present invention has provide an obvious improvement, which is never anticipated and achieved by any person in the field; therefore, the structure of the present invention is deemed unique.

What is claimed is:

1. A lock furnished with a replaceable lock core, comprising:

a lock casing furnished with a cylindrical hole for mounting an inner lock assembly, and said lock casing also furnished with a catch slot so as to have said lock casing and said inner lock assembly engaged together;

an inner lock assembly including:

a sleeve being a cylindrical member, and furnished with a limit slot for receiving a catch pin, and center thereof furnished with a cylindrical hole for mounting a control ring and a lock core;

a control ring mounted in said cylindrical hole of said sleeve; inner surface of said control ring furnished with a guide slot, of which one side furnished with a deeper control cylindrical surface, while other side thereof furnished with a shallow control cylindrical surface;

a lock core, including an upper tumbler base, a lower tumbler base, a plurality of front tumblers, of rear tumblers and of springs; one side of said lower tumbler base furnished with a cylindrical hole for receiving a catch pin and a spring; a transmission shaft of said lower tumbler base furnished with a cut slot which is beside said cylindrical hole for mounting a catch pin;

a key having a cylinder-shaped stem, and front end thereof furnished with a plurality of key slots, and front end of a key plate furnished with a positioning block having different length.

2. A lock furnished with a replaceable lock core as claimed in claim 1, wherein said control ring of said inner lock assembly has an outer cylindrical hole with a diameter being equal to that of end surface of said sleeve, and diameter of inner cylindrical hole thereof being slightly larger than outer diameter of said upper tumbler base of said lock core; a retaining ring surface between an inner and an outer cylindrical holes being pushed against with end of each of said front tumblers of said lock core.

3. A lock furnished with a replaceable lock core as claimed in claim 1, wherein a short cylindrical surface of said sleeve in said inner lock assembly is furnished with a guide slot; said control ring in said short cylindrical surface of said sleeve being furnished with a guide slot having the same diameter as aforesaid guide slot, of which one side being furnished with a deeper control cylindrical surface, while other side thereof being furnished with a shallow control cylindrical surface.

4. A lock furnished with a replaceable lock core as claimed in claim 1, wherein front end of a key plate of said key is furnished with a positioning block, which being designed to fit to depth of a longer control cylindrical surface for normal unlocking; upon said key plugged in along a guide slot of said inner lock assembly, and then turning said positioning block clockwise along said longer control cylindrical surface.

5. A lock furnished with a replaceable lock core as claimed in claim 1, wherein front end of a key plate of said key is furnished with a positioning block which being designed to fit to depth of a shorter control cylindrical surface for replacing an inner lock assembly; upon said key plugged in along a guide slot of said inner lock assembly, and then turning said positioning block counter-clockwise along said shorter control cylindrical surface.

6. A lock furnished with a replaceable lock core as claimed in claim 1, wherein surface of said lower tumbler base in said lock core is furnished with a round hole for receiving a catch pin and a spring; after said lock core being mounted in a cylindrical hole of said sleeve, inner end of said catch pin pushing against a surface of said transmission shaft, while outer end thereof being a shorter shaft with a smaller diameter to extend through a limit slot.

7. A lock furnished with a replaceable lock core as claimed in claim 1, wherein center of said lower tumbler base in said lock core is furnished with a transmission shaft, of which one side furnished with a cut slot; upon said cut slot moved under said catch pin, outer end of said catch pin being set at same level with said outer surface of said sleeve.

* * * * *